United States Patent [19]

Nakajima et al.

[11] Patent Number: 5,016,057

[45] Date of Patent: May 14, 1991

[54] METHOD FOR CONTROLLING ROTATION OF A FIXING ROLLER

[75] Inventors: Yoshihiro Nakajima; Kunihiro Onishi, both of Osaka; Akihiro Takada, Neyagawa, all of Japan

[73] Assignee: Mita Industrial Co., Ltd., Osaka, Japan

[21] Appl. No.: 578,702

[22] Filed: Sep. 6, 1990

[51] Int. Cl.[5] ..... G03G 15/20

[52] U.S. Cl. ..... 355/282; 100/35; 100/47; 100/172

[58] Field of Search ..... 355/282, 289, 290, 295; 100/172, 176, 35, 47

[56] References Cited

FOREIGN PATENT DOCUMENTS 0188673 10/1984 Japan ..... 355/282

2106450 4/1983 United Kingdom ..... 355/290

*Primary Examiner*—A. T. Grimley
*Assistant Examiner*—Pat J. Stanzione
*Attorney, Agent, or Firm*—Jordan and Hamburg

[57] ABSTRACT

A method for controlling rotation of a fixing roller, the fixing roller being rotated by a first motor and a second motor, the first motor being driven at a high speed, the second motor being driven at a low speed, the torques of the first motor and the second motor being transmitted to a rotary shaft of the fixing roller through respective one-way clutches, the method includes steps of starting the driving of the second motor immediately before the driving of the first motor is stopped, and keeping the driving of the second motor at least until the driving of the first motor is started.

3 Claims, 3 Drawing Sheets

METHOD FOR CONTROLLING ROTATION OF A FIXING ROLLER

BACKGROUND OF THE INVENTION AND RELATED ART STATEMENT

The present invention relates to a method for controlling rotation of a fixing roller which requires large torque at the time of starting and is used in an image forming apparatus such as an electrostatic copying apparatus or the like.

Japanese Unexamined Patent Publication No. 59-102265 discloses an electrostatic copying apparatus wherein a fixing roller is driven to prevent the fixing roller and a pressing roller from being fixedly connected with each other by toner at the common contact portion when the surface temperature of the fixing roller is lower to a stand-by temperature.

Japanese Unexamined Patent Publication No. 57-129476 discloses a fixing device of external heating type in which two driving sources are provided, int eh time of stand-by, a pressing roller and a fixing roller are not made in pressing contact with each other, the pressing roller and an external heating roller are driven by another driving source so that the fixing roller is prevented from being fixedly connected to the pressing roller.

Japanese Unexamined Patent Publication No. 63-214554 discloses an electrostatic copying apparatus wherein a high-speed main motor and a low-speed fixing motor are connected to a rotary shaft of a fixing roller through respective one-way clutches and the fixing motor is driven immediately before the main motor is started to lower a starting torque required for the main motor.

Since the conventional fixing roller has the period of suspension, the fixing roller and the pressing roller are fixedly connected by toner at the common contact portion. Consequently, greater starting torque is required at the time of starting the main monitor, so that a large amount of current flow or the driving of the main motor is delayed. The fixing device in which the fixing roller is made in non-contact with the pressing roller has a complicated structure.

SUMMARY OF THE INVENTION

It is an object of the present invention to provide a method for controlling rotation of a fixing roller which makes it possible to start a main motor at a low torque.

It is another object of the present invention to provide a method for controlling rotation of a fixing roller, the fixing roller being rotated by a first motor and a second motor, the first motor being driven at a high speed, the second motor being driven at a low speed, the torques of the first motor and the second motor being transmitted to a rotary shaft of the fixing roller through respective one-way clutches, the method comprising steps of starting the driving of the second motor immediately before the driving of the first motor is stopped and keeping the driving of the second motor at least until the driving of the first motor is started.

According to the present invention, the fixing roller and the pressing roller can be prevented from being fixedly connected with each other by toner at the common contact portion. Therefore, a starting torque of the fixing motor can be lowered remarkably. In addition, since the fixing roller is always rotated, the distribution of temperature of the pressing roller is made uniform.

Consequently, stable copying operation can be attainable.

This and other objects, features and advantages of the present invention will become more apparent upon a reading of the following detailed description and drawings.

BRIEF DESCRIPTION OF THE INVENTION

DETAILED DESCRIPTION OF A PREFERRED EMBODIMENT OF THE INVENTION

Figure 4:
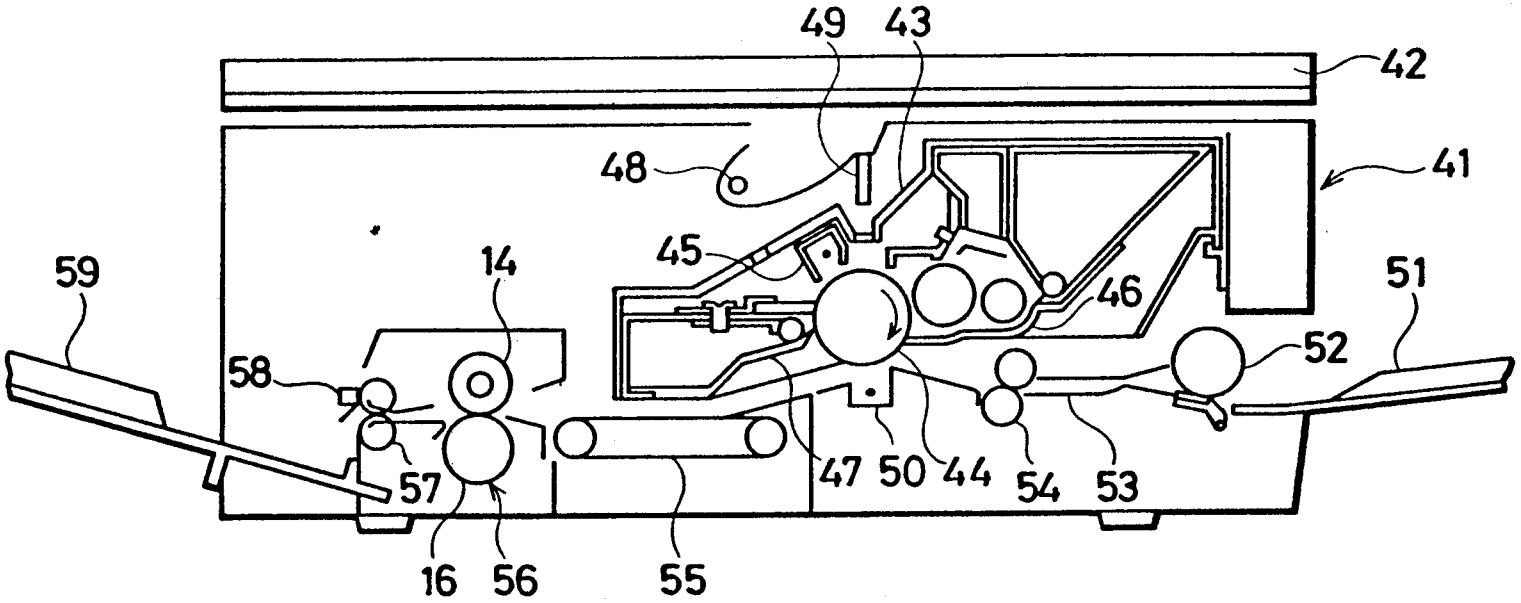
FIG. 4 is a schematic view showing an entire construction of an electrostatic copying apparatus.

FIG. 4 shows an entire construction of an electrostatic copying apparatus in which a method for controlling rotation of a fixing roller according to the present invention is embodied.

FIG. 4, an electrostatic copying apparatus 41 has a document holder 42 reciprocatingly movable over a top surface thereof and a process unit 43 for forming images.

The process unit 43 is removably mountable on the apparatus and has a rotatable photosensitive drum 44 and a main charging device 45, a developing device 46 and a cleaning device 47 and the like provided in the order of rotational direction in the periphery of the photosensitive drum 44. In addition, the electrostatic copying apparatus 41 has an exposure lamp 48 for scanning a document and a convergent lens array member 49. A scanned document image is exposed on the photosensitive drum 44.

A transferring device 50 is provided in the periphery of the photosensitive drum 44 and on the just downstream side of the developing device 46. There are provided a copy paper cassette fitting portion 51, a paper feeding roller 52, a conveying path device 53 for conveying a copy paper sheet toward the photosensitive drum 44 and a pair of resistor rollers 54 as a paper feeding mechanism. Furthermore, there are provided a conveying belt 55 for conveying a copy paper, a fixing device 56 for fixing a toner image on the copy paper, a pair of paper discharging rollers 57 for discharging the copy paper, a paper discharging switch 58 and a paper discharging tray 59 on the downstream side in a direction of conveyance. The paper discharging switch 58 is provided in the vicinity of the just downstream side of the paper discharging roller 57 for detecting the paper discharge.

The fixing device 56 includes a fixing roller 14, a pressing roller 16 and the like.

Figure 1:
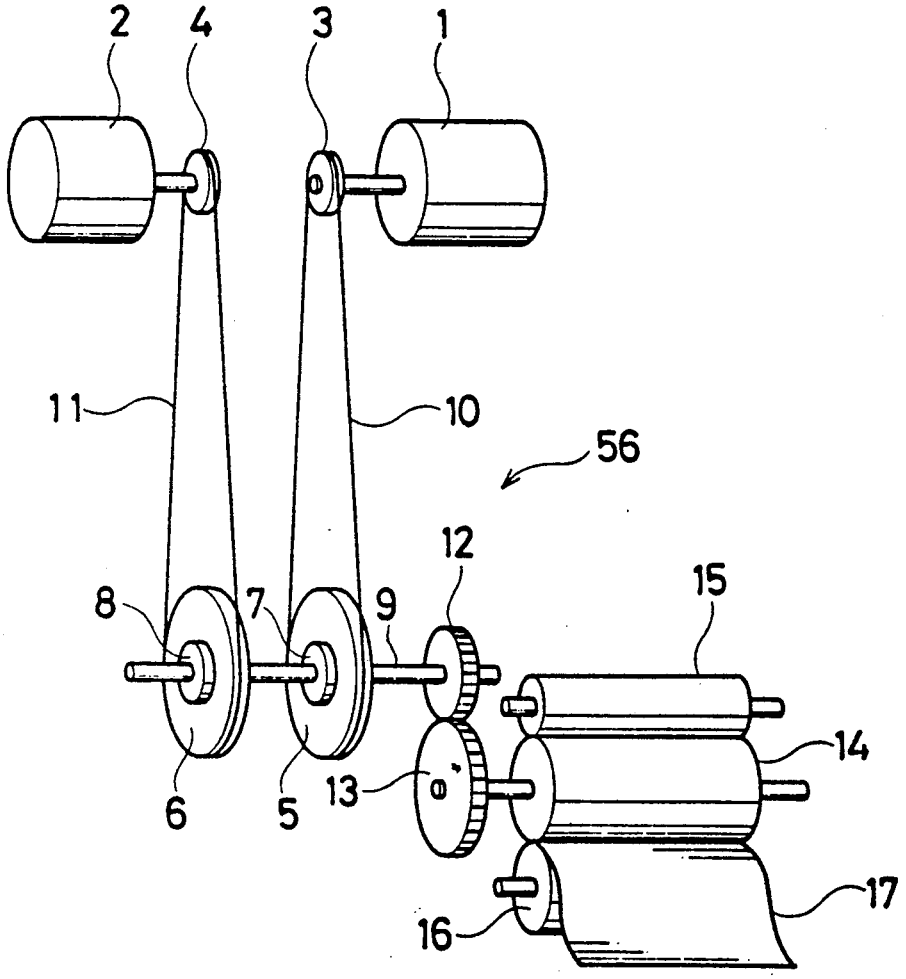
FIG. 1 is a perspective view showing a torque transmission mechanism of a fixing device of the present invention.

FIG. 1 is a perspective view of a torque transmission mechanism in the fixing device 56.

The fixing device 56 has a main motor 1 and a fixing motor 2. The main motor 1 and fixing motor 2 have sprockets 3 and 4 fixed on rotary shafts thereof, respectively. Sprockets 5 and 6 are coaxially fixed on a shaft 9 through one-way clutches 7 and 8. Endless chains 10 and 11 are laid between the sprockets 3 and 5 and between 4 and 6, respectively. The endless chains 10 and 11 transmit the torques of the motors 1 and 2. A gear 12 is fixed on the shaft 9. A gear 13 is fixed on a shaft of the fixing roller 14. The gears 12 and 13 are engaged to each other so that the shaft of the fixing roller 14 is driven.

An oil coating roller 15 has silicon coil impregnated therein and comes in contact with the fixing roller 14 at a proper pressure. The pressing roller 16 presses a copy paper 17 against the fixing roller 14 so that the fixing is suitably performed. The fixing roller 14 has a heater (not shown) for heating the fixing roller 14.

With the above construction, when a copy switch is pressed down so that the main motor 1 rotates, the torque is transmitted to the sprocket 5 and the one-way clutch 7 through an endless chain 10 to rotate the shaft 9. The torque of the shaft 9 is transmitted to the fixing roller 14 through the gears 12 and 13, so that the fixing roller 14 is rotated at a predetermined high speed.

When the fixing motor 2 rotates, its torque is transmitted to the shaft 9 through the endless chain 11, the sprocket 6 and the one-way clutch 8. Then, the torque is transmitted to the fixing roller 14 through the gears 12 and 13, so that the fixing roller 14 is rotated at a predetermined low speed. In the case in which both the main motor 1 and the fixing motor 2 rotate, the torque of the main motor 1 for rotating at a high speed by means of the one-way clutches 7 and 8 is transmitted to the fixing roller 14 with priority.

There will be described an operation of controlling the rotation of the fixing roller with reference to FIGS. 2 and 3.

Figure 2:
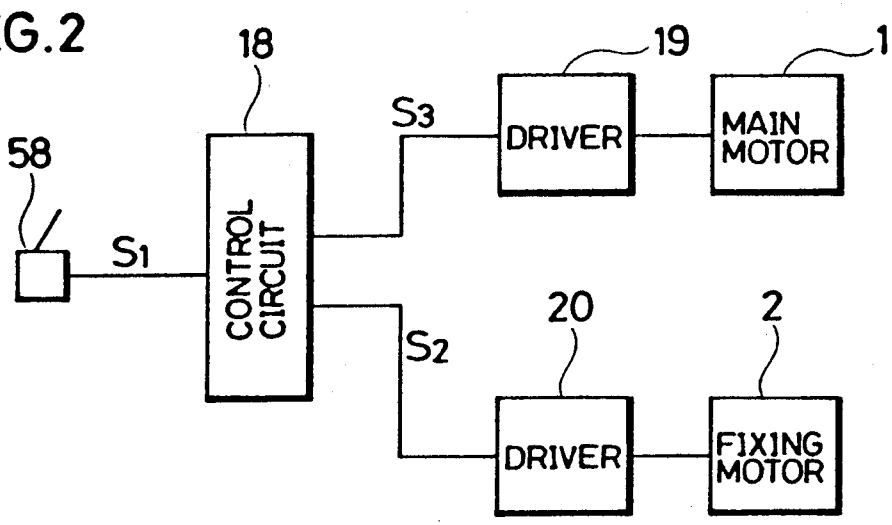
FIG. 2 is a block diagram of a control circuit for controlling first and second motors shown in FIG. 1.

FIG. 2 is a block diagram showing a control circuit for controlling the main motor 1 and the fixing motor 2 in FIG. 1. FIG. 3 is a timing chart of control signals.

Figure 3:
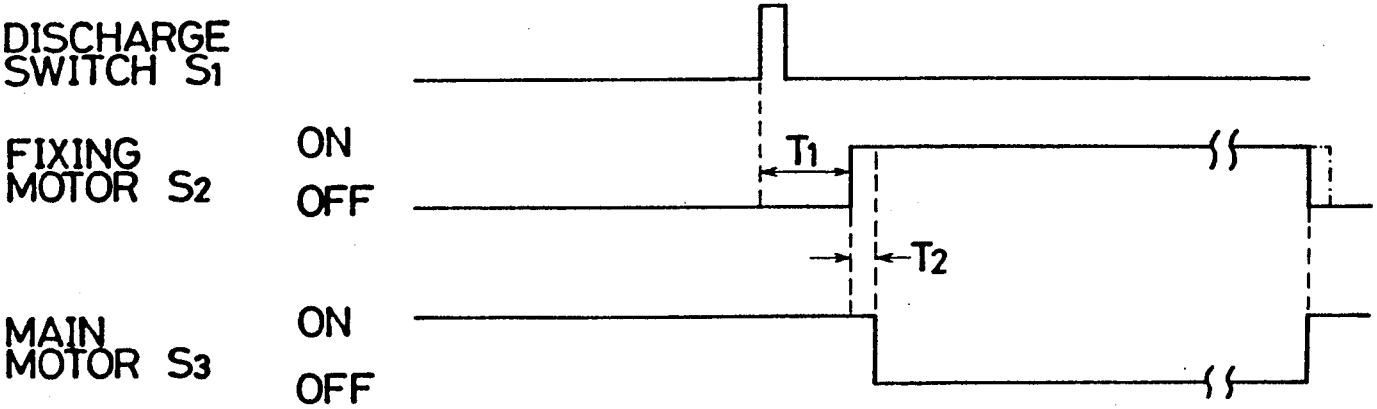
FIG. 3 is a timing chart of control signals.

The paper discharging switch 58 detects the copy paper discharged from the pair of paper discharging rollers 57 and then generates a discharge signal S1 shown in FIG. 3. A control circuit 18 generates control signals S2 and S3 shown in FIG. 3 to the motors 1 and 2 based on the discharge signal S1 of the paper discharging switch 58. Drivers 19 and 20 supply driving force to the main motor 1 and the fixing motor 2 based on the control signals S2 and S3, respectively.

With the above construction, when the copying operation is started and then the paper fixed by the fixing roller 14 rotated by the main motor 1 at a high speed in synchronization with the copying operation is discharged through the pair of discharge rollers 57, the paper discharging switch 58 detects the paper to generate the discharge signal S1. When the discharge signal S1 is generated, the control circuit 18 changes the control signal S2 to a high level after a predetermined time (T1) of, for example, about 5 seconds. Consequently, the driver 20 supplies the driving force to the fixing motor 2 so that the rotation of the fixing roller 14 is started.

At this time, the torque is transmitted from the main motor 1 to the fixing roller 14 through the one-way clutch 8 to drive the fixing roller.

On the other hand, the control circuit 18 changes the control signal S3 to a low level after another predetermined time (T2) of, for example, about 1 second. Consequently, the driver 19 stops supplying of the driving force to the main motor 1.

Accordingly, the fixing roller 14 is rotated and driven by the fixing motor 2 at the low speed after a lapse of the predetermined time (T2). The paper is discharged and then the fixing motor 2 is rotated and driven immediately before the rotation of the main motor 1 is stopped (the time (T1)). Thereby, the rotation of the fixing roller 14 is continued.

When the copy switch is pressed down, the control circuit 18 changes the control signal S3 to the high level, so that the rotation of the main motor 1 is started again. In addition, the control circuit 18 changes the control signal S2 to the low level, so that the rotation of the fixing motor 2 is stopped. Consequently, the rotation of the fixing roller 14 is always kept.

The control signal S2 may be generated in such a way that the rotation of the fixing motor 2 is stopped behind the start of the rotation of the main motor 1 (a waveform shown in dashed line of FIG. 3).

Although the present invention has been fully described by way of example with reference to the accompanying drawings, it is to be understood that various changes and modifications will be apparent to those skilled in the art. Therefore, unless otherwise such changes and modifications depart from the scope of the invention, they should be construed as being included therein.

What is claimed is:

1. A method for controlling rotation of a fixing roller, the fixing roller being rotated by a first motor and a second motor, the first motor being driven at a high speed, the second motor being driven at a low speed, the torques of the first motor and the second motor being transmitted to a rotary shaft of the fixing roller through respective one-way clutches, the method comprising the steps of;

starting the driving of the second motor immediately before the driving of the first motor is stopped; and keeping the driving of the second motor at least until the driving of the first motor is started.

2. A method according to claim 1 wherein the driving of the second motor is stopped at the same time as the driving of the first motor is started.

3. A method according to claim 1 wherein the driving of the second motor is stopped after the driving of the first motor is started.

* * * * *

UNITED STATES PATENT AND TRADEMARK OFFICE

CERTIFICATE OF CORRECTION

PATENT NO. : 5,016,057

DATED : May 14, 1991

INVENTOR(S) : Yoshihiro Nakajima et al

It is certified that error appears in the above-identified patent and that said Letters Patent is hereby corrected as shown below:

Title page, after the filing date add:

-- [30] Foreign Application Priority Data

September 13, 1989 Japan .....1-237950 --.

Signed and Sealed this

Twentieth Day of October, 1992

*Attest:*

DOUGLAS B. COMER

*Attesting Officer*

*Acting Commissioner of Patents and Trademarks*